US007549508B2

(12) United States Patent
Okawara et al.

(10) Patent No.: US 7,549,508 B2
(45) Date of Patent: Jun. 23, 2009

(54) MUFFLER

(75) Inventors: Masahiro Okawara, Tokyo (JP); Koichi Fujita, Tokyo (JP); Yoshiyuki Fujii, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/511,512

(22) Filed: Aug. 29, 2006

(65) Prior Publication Data

US 2007/0051558 A1 Mar. 8, 2007

(30) Foreign Application Priority Data

Sep. 2, 2005 (JP) ..... 2005-255388

(51) Int. Cl.
*F01N 7/08* (2006.01)

(52) U.S. Cl. ..... 181/227; 181/212; 181/228; 29/890.08

(58) Field of Classification Search ..... 181/227, 181/282, 228, 212; 29/890.08, 513
See application file for complete search history.

(56) References Cited

U.S. PATENT DOCUMENTS 2,834,657 A * 5/1958 Houdry ..... 422/179
2,853,367 A * 9/1958 Reitzel et al. ..... 422/179
3,209,862 A * 10/1965 Young ..... 181/245
RE30,306 E * 6/1980 Moore et al. ..... 181/229
4,235,304 A * 11/1980 Suyama ..... 181/265
4,333,545 A * 6/1982 Roberts ..... 181/282
4,381,045 A * 4/1983 Buchwalder ..... 181/265
4,516,659 A * 5/1985 Hall et al. ..... 181/243
4,851,298 A * 7/1989 Fukuda ..... 428/586
5,198,625 A * 3/1993 Borla ..... 181/248
5,422,445 A * 6/1995 Baird et al. ..... 181/282
5,444,197 A * 8/1995 Flugger ..... 181/264
5,477,015 A * 12/1995 Preslicka et al. ..... 181/282
5,943,891 A * 8/1999 Takagi et al. ..... 72/51
6,257,367 B1 * 7/2001 Allman ..... 181/282
6,405,827 B1 * 6/2002 Church ..... 181/243
6,415,889 B1 * 7/2002 Wyatt ..... 181/282
6,446,322 B1 * 9/2002 Church ..... 29/513
6,463,655 B1 * 10/2002 Williams et al. ..... 29/890.08
7,293,628 B2 * 11/2007 Takahashi ..... 181/227
2005/0155820 A1 * 7/2005 Flugger ..... 181/282
2007/0051558 A1 * 3/2007 Okawara et al. ..... 181/282

FOREIGN PATENT DOCUMENTS

JP 2002-206422 A 7/2002

* cited by examiner

*Primary Examiner*—Jeffrey Donels
*Assistant Examiner*—Forrest M Phillips
(74) *Attorney, Agent, or Firm*—Foley & Lardner LLP

(57) ABSTRACT

A muffler includes a shell main that is formed in a cylinder with two openings opposite to each other being apart from each other in an axial direction of the shell main body by rolling a flat plate to have an overlapped portion overlapping an inner end portion and a shell portion, and a pair of end plates that are partially inserted in the openings of the shell main body and fixed to the shell main body. The inner end portion is formed with two cut-off portions at opening-side edges of the inner end portion, respectively, to avoid interference between the inner end portion and the end plates when the end plates are inserted into the openings of the shell main body.

20 Claims, 4 Drawing Sheets

PRIOR ART

MUFFLER

BACKGROUND OF THE INVENTION

1. Field of the Invention

The present invention relates to a muffler that is used in an exhaust system of a combustion engine mounted on a motor vehicle or the like and is equipped with an inner shell portion and an outer shell portion wrapping an outer surface of the inner shell portion.

2. Description of the Related Art

A muffler of this kind is disclosed in Japanese patent laying-open publication No. 2002-206422. This muffler has a shell main body made of a double-rolled flat plate or triple-rolled flat plate, forming an inner shell portion and an outer shell portion, where their overlapped portions are spot-welded together. This shell main body is formed at each end portion with an opening portion, which is fixed by an end plate so that its opening is closed.

Such a conventional muffler is also shown in FIGS. 7 and 8. The muffler includes a shell main body 01 and two end plates 02 and 02. The shell main body 01 is manufactured by double-rolling a flat plate to have two layers forming an inner shell portion 04 and an outer shell portion 03 wrapping an outer surface of the inner shell portion 04 so that transmitting noise from an interior of the muffler can be reduced. The outer and inner shell portions 03 and 04 are partially overlapped to form overlapped portions 05, which are spot-welded together at several positions indicated by 06. Two end plate 02 shaped like a dish are press-fit into openings of the shell main body 01, respectively, and then an outer peripheral portion of the end plates 02 and the end portions of the outer shell portion 03 are laser-welded or metal-insert-gas-welded along their outer circumferences 07 to fix with each other.

The conventional mufflers, however, encounter a problem in that the end plates 02 can not be smoothly inserted into the openings of the shell main body 01 before the end plates 02 are press-fit into the openings, because the outer peripheral portion of the end plate 02 sometimes interferes with an opening side end portion of the inner shell portion 04, which is easily twisted and projected inwardly due to residual stress caused when the opening side end portion, to be the inner shell portion 04, of the flat plate is inserted into a groove of a jig to be clamped and the flat plate is rolled around the jig to form the shell main body 01. The unsmooth insertion and interference of the end plates 02 cause trouble in arrangement thereof before press-fitting, decreasing productivity rate of the mufflers.

SUMMARY OF THE INVENTION

It is an object of the present invention to provide a muffler which overcomes the foregoing drawbacks and can smoothly insert an end plate into an opening of a shell main body manufactured by rolling a plate before they are fit and fixed with each other, thereby increasing its productivity rate.

According to an aspect of the present invention there is provided a muffler including a shell main that is formed in a cylinder with two openings opposite to each other being apart from each other in an axial direction of the shell main body by rolling a flat plate to have an inner shell portion and an outer shell portion where the inner and outer shell portions have an overlapped portion overlapping an inner end portion of the inner shell portion and an outer end portion of the outer shell portion so that the inner end portion is located at an innermost position of the cylinder of the shell main body and at an inner side of the outer end portion, where the inner end portion forms a part of the openings. A pair of end plates are partially inserted in the openings of the shell main body and are fixed to the shell main body. The inner end portion of the overlapped portion is formed with two cut-off portions at opening-side edges of the inner end portion, respectively, to avoid interference between the inner end portion and the end plates when the end plates are inserted into the openings of the shell main body, and the cut-off portions being located at an inner side of the cylinder and contactable with inserting portions of the end plates.

Therefore, the end plates can be smoothly inserted into the opening of the shell main body manufactured by rolling the plate before they are fit and fixed with each other, thereby increasing its productivity rate.

Preferably, the cut-off portions are formed to have a circumferential length substantially equal to a circumferential length of the overlapped portions.

This causes opening-side portions of the shell main body corresponding to the overlapped portions to have two layers similarly to those of the shell main body excluding the overlapped portions. Therefore, laser-welding can be stably carried out along entire circumferences of the opening-side end portions of the shell main body 1 under the same welding conditions.

Preferably, the cut-off portions are formed to have an axial length not less than an inserting portion of the end plate.

This enables the inner end portion to avoid interference with the inserting portion of the end plate when the inserting portions inserted into the opening of the shell main body, and accordingly their insertion can be smoothly and stably carried out.

Preferably, the inserting portions have reduced diameter portions.

This reduced diameter portions enables the end plates to be more smoothly and stably inserted into the openings of the shell main body.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
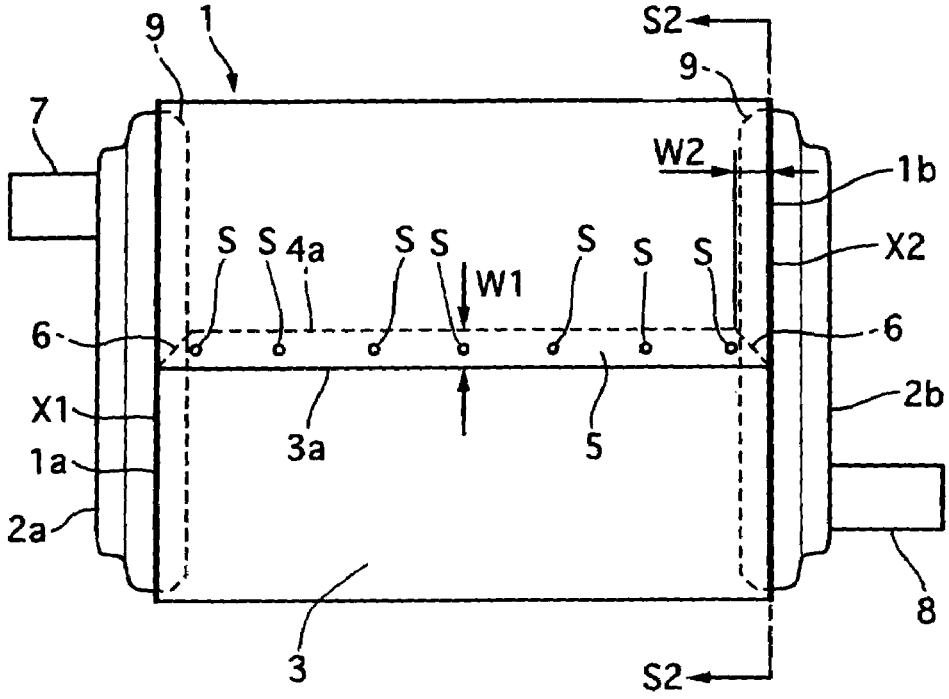
FIG. 1 is a plane view showing a muffler of an embodiment according to the present invention.

Throughout the following detailed description, similar reference characters and numbers refer to similar elements in all figures of the drawings, and their descriptions are omitted for eliminating duplication.

A muffler of an embodiment according to the present invention will be described with reference to the accompanying drawings.

Referring to FIG. 1, there is shown a muffler of the embodiment. The muffler of the embodiment is used for an exhaust system mounted on a motor vehicle, and includes a shell main body 1, a pair of end plates 2*a* and 2*b*, and its inner construction 11 shown in FIG. 3.

The shell main body 1 is a double-rolled flat plate having two layers forming an outer shell portion 3 and an inner shell portion 4 wrapped by the outer shell portion 3, so that the shell main body 1 has two openings 1*a* and 1*b* at its opposite end portions thereof and being apart from each other in an axial direction of the shell main body 1.

Figure 2:
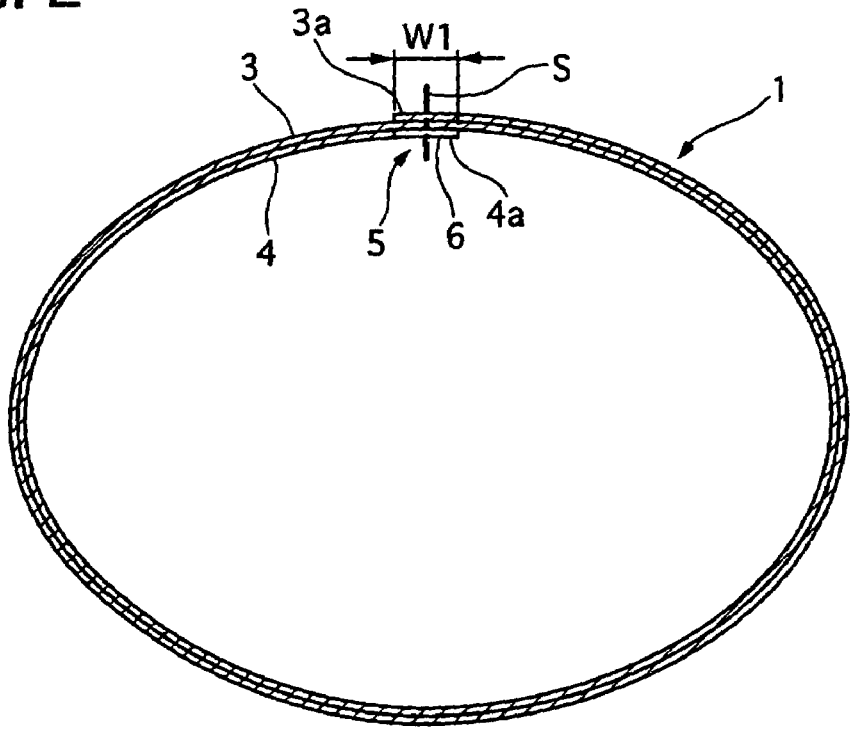
FIG. 2 is a cross-sectional view showing a shell main body of the muffler, taken along the line S2-S2 in FIG. 1.

An outer end portion 3*a* of the outer shell portion 3 and an inner end portion 4*a* of the inner shell portion 4 are overlapped to form overlapped portions 5 with a circumferential length W1 as shown in FIGS. 1 and 2 in a circumferential direction of the shell main body 1. The overlapped portions 5 are spot-welded at seven positions indicated by S along the axial direction. Instead of spot-welding, the overlapped portions 5 may be continuously welded so as to firmly fix them. The outer shell portion 3 and the inner shell portion 4 excluding a portion corresponding to the overlapped portion 5 of the inner end portion 4*a* correspond to a shell portion of the present invention.

The inner end portion 4*a* of the inner shell portion 4 is formed at its opening 1*a*, 1*b* sides with cut-off portions 6, respectively. The cut-off portions 6 are formed in a tapered shape with the circumferential length W1 and an axial length W2. The axial length W2 is set so that it is substantially equal to or more than an axial directional length of inserting portions formed on the end plates 2*a* and 2*b*.

On the other hand, each of the end plates 2*a* and 2*b* is formed like a dish, and has a reduced diameter portion 9, shaped like a circular cone, insertable into the opening 1*a*, 1*b*. The end plate 2*a* has a not-shown through-hole for introducing an inlet pipe therethrough, and the end plate 2*b* has a not-shown through-hole for introducing an outlet pipe 8 therethrough. The inlet pipe 7 is connected with a not-shown upstream side exhaust pipe, and the outlet pipe 8 is connected with a not-shown downstream side exhaust pipe.

Figure 3:
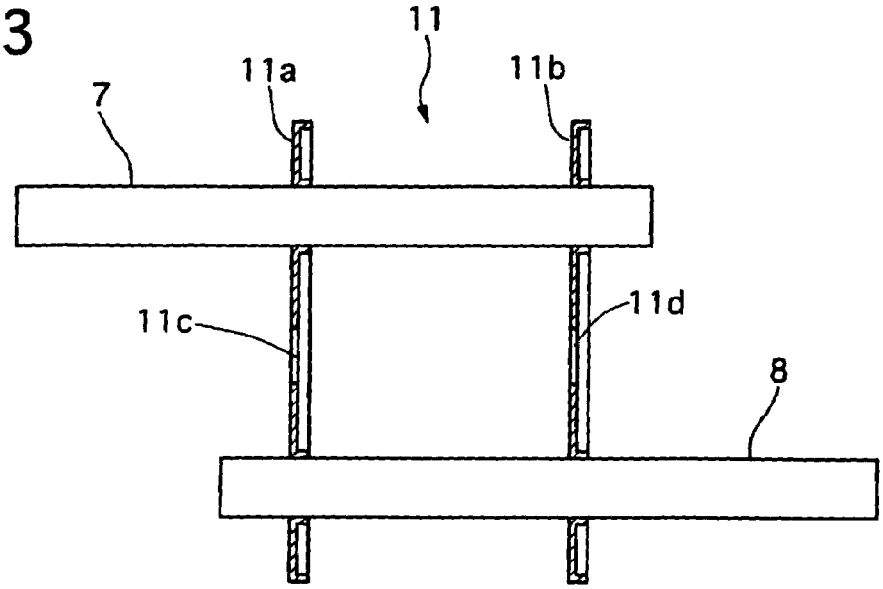
FIG. 3 is a plan view showing an inlet pipe, an outlet pipe, and two baffle plats fixing the inlet and outlet pipes, which are contained in the shell main body.

As shown in FIG. 3, the inner construction 11 includes the inlet pipe 7, the outlet pipe 8 disposed in parallel with the inlet pipe 7, and two baffle plates 11*a* and 11*b* apart from each other in the axial direction. The baffle plates 11*a* and 11*b* are located in perpendicular to the inlet and outlet pipes 7 and 8 to define three rooms in an inner space of the muffler, supporting them which penetrate their through holes. These rooms are communicated by holes 11*c* and 11*d* formed on the baffle plates 11*a* and 11*b*. The inlet pipe 7 and the outlet pipe 8 are formed with not-shown several holes on their peripheral surfaces. This inner construction 11 is disposed inside of the shell main body 1, and may be constructed arbitrarily in its arrangement, the number of baffle plates, addition of an intermediate pipe, and others.

The muffler of the embodiment is manufactured as follows.

Figure 4:
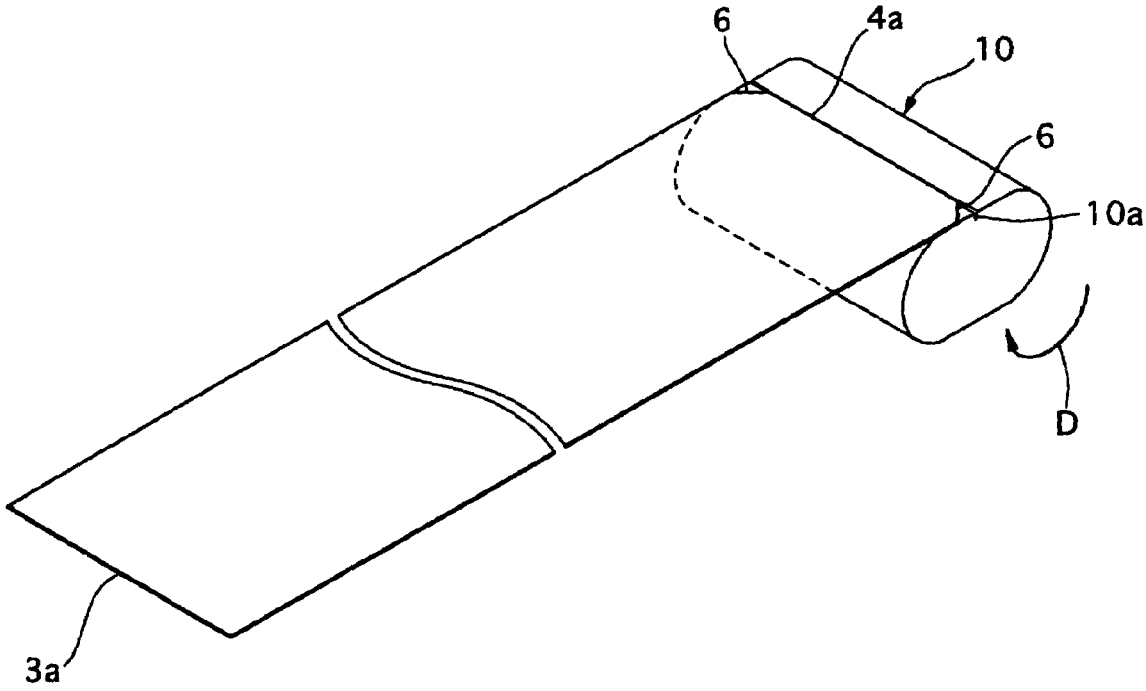
FIG. 4 is a perspective view showing how a shell plate is rolled to form the shell main body shown in FIG. 2.

A flat plate is prepared and cut off to be formed with cut-off portions 6 at both edges of its end portion to be the inner shell portion 4 as shown in FIG. 4. This end portion of the flat plate is inserted into a groove 10*a* of a jig 10 shaped in elliptic cylinder so as to be clamped, and then the flat plate is double-rolled around the jig 10 by rotating the jig 10 in a rotating direction D to form the shell main body 1 with the outer shell portion 3 and the inner shell portion 4. In this formation of the shell main body, the outer end portion 3*a* of the outer shell portion 3 and the inner end portion 4*a* of the inner shell portion 4 are partially overlapped with each other to form the overlapped portions 5. The jig 10 is brought out of the shell main body 1.

The overlapped portions 5 are spot-welded at the positions S in the axial direction.

The interior construction 11 is inserted into and arranged in the inner space of the shell main body 1, and then the baffle plates 11*a* and 11*b* are spot-welded with the shell main body 1.

Figure 5:
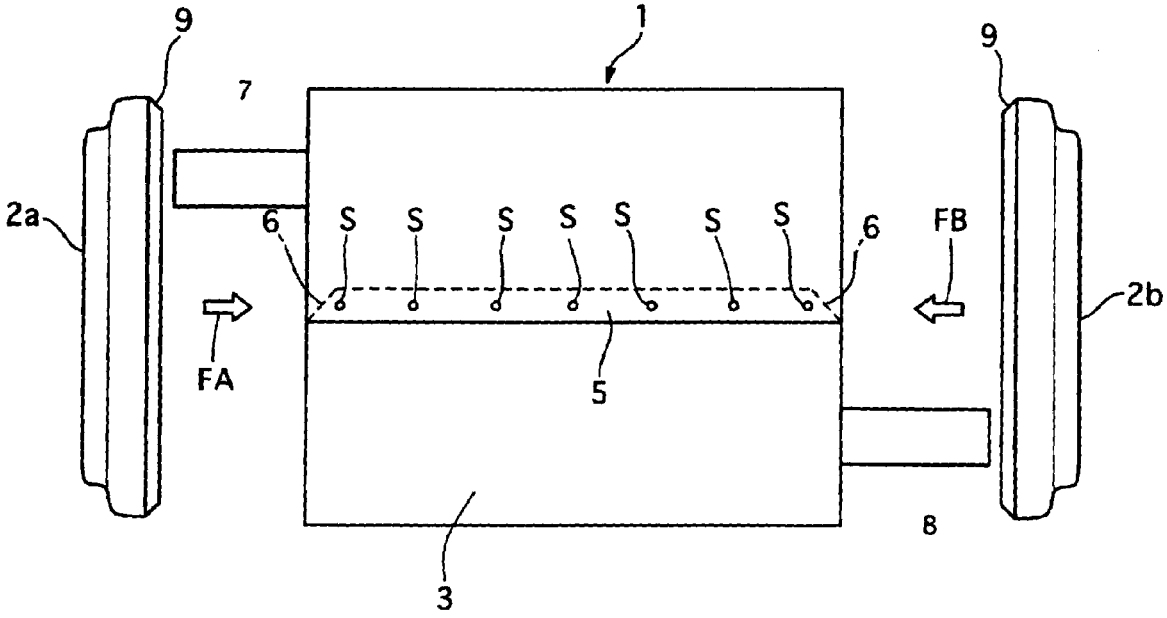
FIG. 5 is a plan view showing how end plates are attached to the shell main body formed with cut-off portions.
Figure 6:
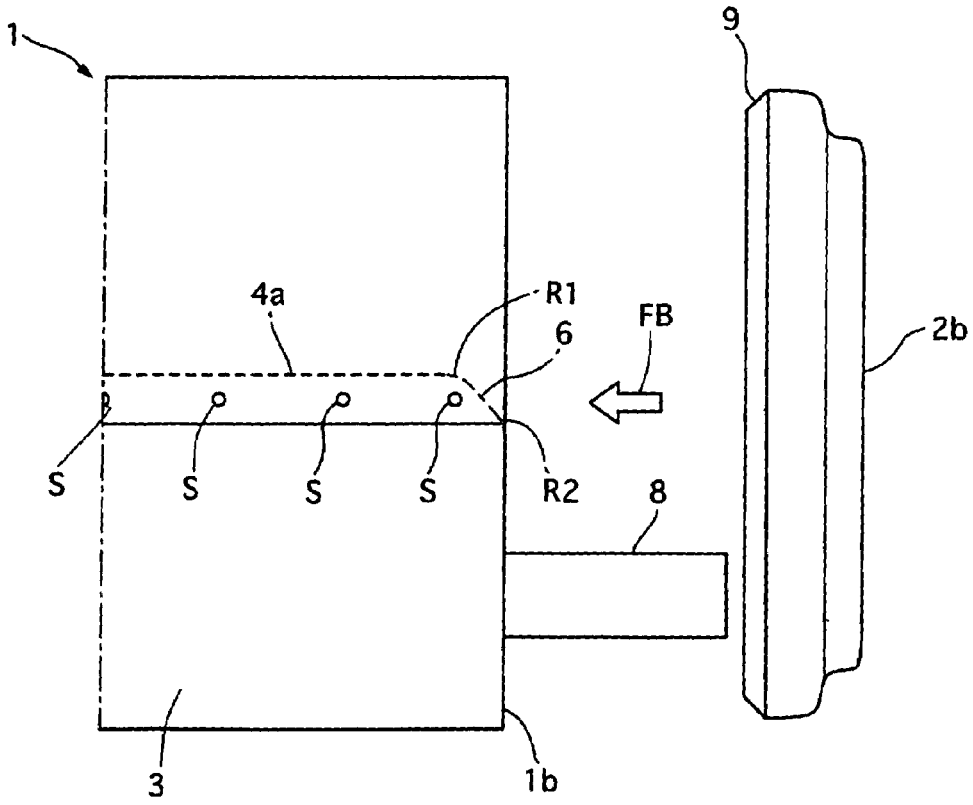
FIG. 6 is a partial plan view showing a modification of the cut-off portions formed on the shell main body shown in FIG. 5.
Figure 7:
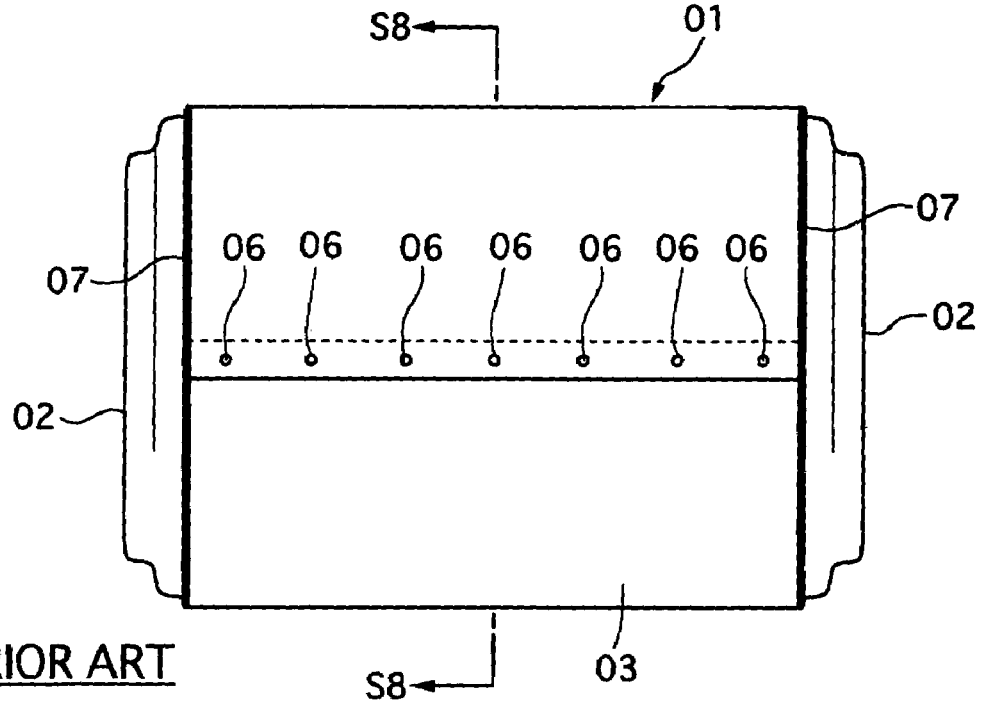
FIG. 7 is a plan view showing a muffler manufactured by using a prior art.
Figure 8:
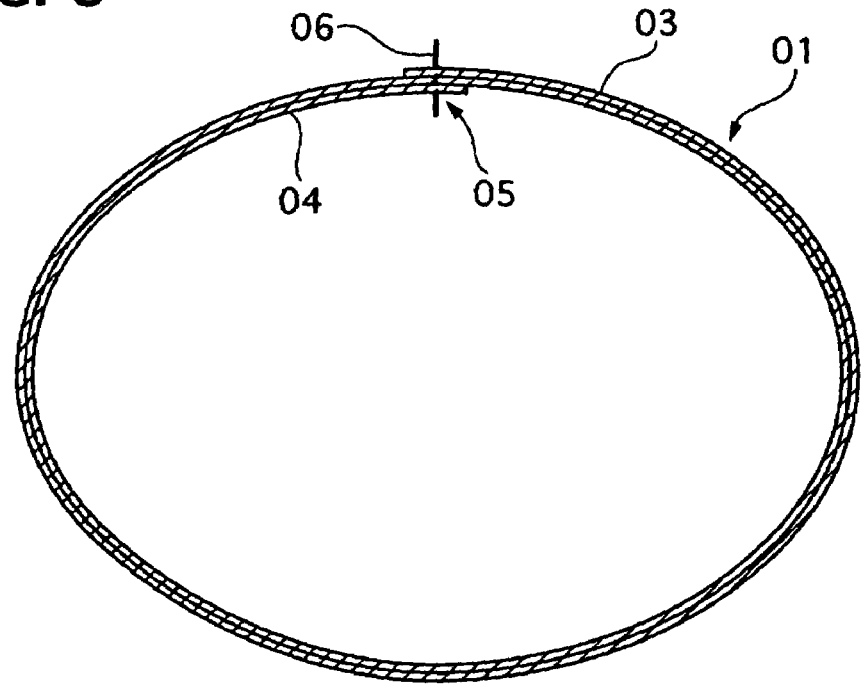
PRIOR ART FIG. 8
FIG. 8 is a cross-sectional view showing a shell main body used in the muffler shown in FIG. 7, taken along the line S8-S8 in FIG. 7.

The end plates 2*a* and 2*b* are brought in directions FA and FB, passing the inlet pipe 7 and the outlet pipe 8 therethrough, to be inserted into the openings 1*a* and 1*b* of the shell main body 1 as shown in FIG. 5. In this insertion of the end plates 2*a* and 2*b*, they can be smoothly inserted into the openings 1*a* and 1*b*, because the opening-side edges of the inner end portions 4*a* of the inner shall portion 4 are cut off, thereby not obstructing the insertion thereof. The cut-off portions 6 can avoid the interference therebetween and decrease contact resistance therebetween. In addition, the reduced diameter portions 9 of the end plates 2*a* and 2*b* enables them to be smoothly and stably inserted into the openings 1*a* and 1*b*. Accordingly, the end plates 2*a* and 2*b* can be smoothly and stably inserted in the openings 1*a* and 1*b* and positioned therein.

Then, the end plates 2*a* and 2*b* positioned in the openings 1*a* and 1*b* are press-fit therein to be fixed with the shell main body 1.

The end plates 2*a* and 2*b* and the opening-side end portions of the shell main body 1 are laser-welded with each other along the outer circumferences thereof indicated by X1 and X2 as shown in FIG. 1.

In this muffler constructed above, exhaust gas outputted from an engine enters the inlet pipe 7 to pass through the rooms, decreasing its noise, and then is discharged through the outlet pipe 8.

The muffler of the embodiment has the following advantages.

The muffler of the embodiment is formed with the cut-off portions 6 on the opening-side edges of the inner end portions 4*a* of the inner shall portion 4, which can prevent interference between the inner end portions 4*a* of the inner shall portion 4 and the end plates 2*a* and 2*b* when the end plates 2*a* and 2*b* is inserted into the openings 1*a* and 1*b* of the shell main body 1. This increases productivity rate of mufflers because of smooth and stable insertion of the end plates 2*a* and 2*b*.

The reduced diameter portions 9 of the end plates 2*a* and 2*b* ensure smooth and stable insertion of the end plates 2*a* and 2*b* into the openings 1*a* and 1*b* of the shell main body 1.

The cut-off portions 6 is set to have the circumferential length W1 substantially equal to a circumferential length of the overlapped portions 5, and accordingly opening-side portions of the shell main body 1 corresponding to the overlapped portions 5 have two layers similarly to those of the shell main body 1 excluding the overlapped portions 5. Therefore, laser-welding can be stably carried out along entire circumferences of the opening-side end portions of the shell main body 1 under the same welding conditions.

While the invention has been particularly shown and described with reference to preferred embodiments thereof, it will be understood by those skilled in the art that the foregoing and other changes in form and details can be made therein without departing from the spirit and scope of the invention.

For example, the shell main body 1 of the embodiment is double-rolled, but it is not limited. Single-rolled or multi-rolled, more-than-two-rolled formation may be employed. Cross-sectional shape of the shell main body 1 may be set arbitrarily.

In the above embodiment, the inner shell 1 and the outer shell 2 are made of one flat plate, but they may be formed of two flat plates or more. In the latter, the flat plates may be different in thickness and material.

The circumferential W1 and the axial length W2 may be set arbitrarily.

Instead of using the jig 10, the shell main body 1 may be formed by using the baffle plates 11*a* and 11*b* of the interior construction 11 and others.

Configuration of the cut-off portions 6 may be set arbitrarily. For example, the cut-off portions 6 is formed to have a curve R1 at edges of the inner end portion 4*a* and a curve R2 at opening-side edges thereof so as to enable the end plates 2*a* and 2*b* to be inserted into the shell main body 1 more smoothly.

The muffler of the present invention may be used for others instead of an exhaust system of a motor vehicle.

The entire contents of Japanese Patent Application No. (Tokugan) 2005-255388 filed Sep. 2, 2005 are incorporated herein by reference.

What is claimed is:

1. A muffler comprising:

a shell main body that is formed in a cylinder with two openings opposite to each other being apart from each other in an axial direction of the shell main body by rolling a flat plate to have an inner shell portion and an outer shell portion where the inner and outer shell portions have an overlapped portion overlapping an inner end portion of the inner shell portion and an outer end portion of the outer shell portion so that the inner end portion is located at an innermost position of the cylinder of the shell main body and at an inner side of the outer end portion, the inner end portion forming a part of the openings; and a pair of end plates that are partially inserted in the openings of the shell main body and are fixed to the shell main body, wherein the inner end portion of the overlapped portion is formed with two cut-off portions at opening-side edges of the inner end portion, respectively, to avoid interference between the inner end portion and the end plates when the end plates are inserted into the openings of the shell main body, the cut-out portions being located at an inner side of the cylinder and contactable with inserting portions of the end plates.

2. The muffler according to claim 1, wherein the cut-off portions are formed to have a circumferential length substantially equal to a circumferential length of the overlapped portion.

3. The muffler according to claim 2, wherein the cut-off portions are formed to have an axial length not less than an axial length of an inserting portion of the end plate.

4. The muffler according to claim 3, wherein the inserting portions have reduced diameter portions.

5. A muffler comprising:

a shell main body that is formed in a cylinder with two openings opposite to each other being apart from each other in an axial direction of the shell main body by rolling a flat plate to have an overlapped portion overlapping an inner end portion and an outer end portion; and a pair of end plates that are partially inserted in the openings of the shell main body and fixed to the shell main body, wherein the inner end portion is formed with two cut-off portions at opening-side edges of the inner end portion, respectively, to avoid interference between the inner end portion and the end plates when the end plates are inserted into the openings of the shell main body, and the cut-off portions are formed to have an axial length not less than inserting portions of the end plates.

6. The muffler according to claim 5, wherein the inserting portions have reduced diameter portions.

7. The muffler according to claim 1, wherein the end plates have reduced diameter portions.

8. The muffler according to claim 1, wherein the cylinder of the shell main body is made of a contiguous piece of material.

9. The muffler according to claim 1, wherein the entire portion of the shell main body is made of the same material.

10. The muffler according to claim 1, wherein the cylinder of the shell main body is monolithic.

11. The Muffler according to claim 1, wherein the outer end portion is located at an outermost position of the cylinder of the shell body.

12. The muffler according to claim 11, wherein the cut-off portions are formed to have a circumferential length substantially equal to a circumferential length of the overlapped portion.

13. The muffler according to claim 12, wherein the cut-off portions are formed to have an axial length not less than an axial length of an inserting portion of the end plate.

14. The muffler according to claim 13, wherein the inserting portions have reduced diameter portions.

15. The muffler according to claim 5, wherein the shell main body is formed in a cylinder with two openings opposite to each other being apart from each other in an axial direction of the shell main body by rolling the flat plate to have an overlapped portion overlapping an inner end portion and an outer end portion of the outer shell portion so that the inner end portion is located at an innermost position of the cylinder of the shell main body and at an inner side of the outer end portion and the outer end portion is located at an outermost position of the cylinder of the shell body.

16. The muffler according to claim 15, wherein the inserting portions have reduced diameter portions.

17. The muffler according to claim 11, wherein the end plates have reduced diameter portions.

18. The muffler according to claim 11, wherein the cylinder of the shell main body is made of a contiguous piece of material.

19. The muffler according to claim 11, wherein the entire portion of the shell main body is made of the same material.

20. The muffler according to claim 11, wherein the cylinder of the shell main body is monolithic.

* * * * *